US005472247A

United States Patent [19]

Monson

[11] Patent Number: 5,472,247

[45] Date of Patent: Dec. 5, 1995

[54] MULTI-POINT HIGH SECURITY LOCKING MECHANISM FOR LOTTERY MACHINES

[75] Inventor: Gavin M. Monson, Fairfield, Ohio

[73] Assignee: Interlott, Inc., Cincinnati, Ohio

[21] Appl. No.: 276,341

[22] Filed: Jul. 18, 1994

[51] Int. Cl.[6] ..... E05C 1/06

[52] U.S. Cl. ..... 292/36; 70/108; 292/167

[58] Field of Search ..... 292/33, 34, 36, 292/37, 40, 165, 167; 70/108, 113, 118, 120

[56] References Cited

U.S. PATENT DOCUMENTS

| | | | |
|---|---|---|---|
| 3,255,618 | 6/1966 | Hermann | 292/40 X |
| 3,953,061 | 4/1976 | Hansen et al. | 292/36 X |
| 4,015,866 | 4/1977 | Marsh et al. | 292/36 |
| 4,288,944 | 9/1981 | Donovan | 292/40 X |
| 4,387,917 | 6/1983 | Cocker | 292/40 |
| 4,601,499 | 7/1986 | Kim | 292/36 |
| 5,280,755 | 1/1994 | Batur | 292/36 X |

*Primary Examiner*—Peter M. Cuomo
*Assistant Examiner*—Monica E. Millner
*Attorney, Agent, or Firm*—Thomas M. Champagne; Jon L. Roberts; Roberts & Associates

[57] ABSTRACT

A locking mechanism which provides a number of resistance points, all of which function to impede the opening of a door located on the chassis of a lottery dispensing machine or any other enclosure that must be secured. The locking mechanism includes a rotating cam which sets the lock in motion. Rotation of the cam is translated into reciprocating motion of a number of bolts which move into a locked position. Once the bolts are in a fully locked position, movement of the door is impeded. If two bolts are used, they face in opposite directions. If more than two bolts are used, they all face in different directions. This makes the lock impossible to jimmy. Further, to successfully pry open the lock would require an effort great enough to cause substantial structural damage to the enclosure itself. A cam extension is also provided which provides extra resistance when the locking mechanism is in a closed position.

20 Claims, 4 Drawing Sheets

MULTI-POINT HIGH SECURITY LOCKING MECHANISM FOR LOTTERY MACHINES

FIELD OF THE INVENTION

The present invention relates generally to means for securing lottery machines, pull tab ticket machines, debit card dispensers, and the like. In particular, the present invention relates to multi-point locking mechanisms having simple designs that are suitable for use with lottery machines.

BACKGROUND OF THE INVENTION

The sale of lottery tickets through self-serve lottery machines is an expanding, billion dollar, worldwide industry. These lottery sales are made through the use of ticket dispensing machines rather than through over-the-counter transactions. A person making a lottery purchase from such a machine selects a type of instant win ticket or a number to be played in a random number drawing, and makes payment for the ticket at the machine. Many forms of payment may be accepted by the machine. Most lottery transactions, however, involve providing the lottery machine with cash prior to the dispensing of a ticket.

When a new instant lottery game is introduced, or when the jackpot of a random number drawing is high, people tend to play the lottery more, that is, tend to spend more money on the lottery. Especially during such high volume sales periods, self-serve lottery machines may contain several thousand dollars in cash. Because these machines are often unattended while in use, the amount of cash inside the machines provides a great temptation to thieves. Thieves also know that in addition to the cash, a potential winning ticket may be found inside the machines, providing further incentive to break in.

Because of this threat of break in and loss of a great deal of cash and lottery tickets, lottery machines must be secured. The machines themselves must be made of a tough material, and all joints must be constructed so that they are tamper resistant. For example, the walls of the machine can be made of a heavy gauge steel, and the joints should be welded or riveted. Further, the openings in the machine from which cash is retrieved by the operator and through which lottery tickets are loaded must be locked by a mechanism that is difficult to compromise.

Single bolt locks are usually good enough to deter an unmotivated thief. However, the amount of money present in a lottery machine usually attracts a more determined criminal. Such a person would have little trouble prying open or jimmying a lock having a single point of resistance. Locks exist which have more than one resistance points. However, these are used in bank vault applications. As a result, the lock mechanisms are extremely large, heavy, and complicated. They are designed to be used in extremely large doors and require much effort to turn even by someone who has legitimately unlocked the lock. In some cases, an electronic means may be necessary to turn the lock bolts once the combination has been entered.

Thus, such a multi-point lock is not suited for use with a lottery ticket dispensing machine. A vault locking mechanism is too large, heavy, and complicated to be used with a relatively lightweight lottery dispensing machine, which may range in size from a small countertop model to a machine approximately the size of a soft drink dispensing machine. It would not be cost effective to build a lottery machine that is as large and sturdy as a bank vault so that a vault locking mechanism can be used. Therefore, a small and lightweight yet nevertheless sturdy and secure multi-point locking mechanism would be more suitable for use with a lottery ticket dispensing machine.

SUMMARY OF THE INVENTION

It is therefore an object of the present invention to provide a locking mechanism for a lottery ticket dispensing machine that has multiple points of resistance.

It is a further object of the present invention to provide a locking mechanism that is small enough to be suitable for use with a lottery ticket dispensing machine.

It is an additional object of the present invention to provide a locking mechanism for a lottery ticket dispensing machine that is difficult to compromise by force.

It is another object of the present invention to provide a locking mechanism for a lottery ticket dispensing machine that is easy to manually open by a person having the correct combination or key.

These and other objects and advantages of the present invention will be apparent to those of ordinary skill in the art upon inspection of the detailed description, drawings, and appended claims.

The present invention is a locking mechanism which provides a number of resistance points, all of which function to impede the opening of a door located on the chassis of a lottery dispensing machine or any other device that must be secured. The locking mechanism includes a rotating cam which sets the lock in motion. Rotation of the cam is translated into reciprocating motion of a number of bolts which move into a locked position. Once the bolts are in a fully locked position, movement of the door is impeded.

If two bolts are used, they face in opposite directions. If more than two bolts are used, they all face in different directions. This makes the lock impossible to jimmy. Further, to successfully pry open the lock would require an effort great enough to cause substantial structural damage to the enclosure itself. A cam extension is also provided which provides extra resistance when the locking mechanism is in a closed position.

DETAILED DESCRIPTION OF THE PRESENT INVENTION

Figure 1:
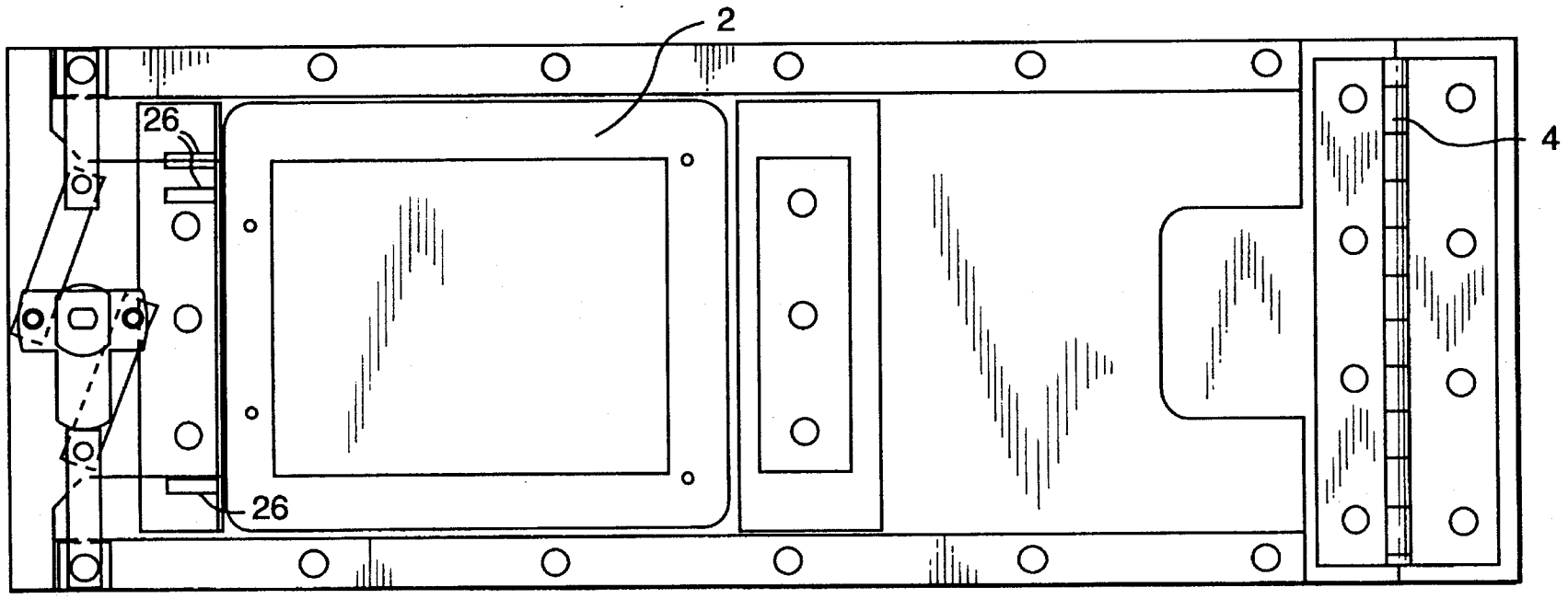
FIG. 1 shows the door of the lottery ticket dispensing machine with a cut-away view of the multiple-point locking mechanism.

Referring to FIG. 1, the door and locking mechanism are described. The following description will refer to a two-bolt embodiment of the present invention. The multiple-point locking mechanism may have any number of bolts, however, and it is contemplated that at least three bolts will be used for maximum security. The two-bolt embodiment is described for simplicity in presentation only.

The door 2 covers the compartment that holds the cash collected from sales of lottery tickets. This door and locking mechanism can also be used to cover the compartment holding lottery tickets or any other valuable contents of the lottery machine. The door 2 pivots about a hinge 4 at a first end of the door 2. The second end of the door 2 is adapted to accept the bolts of the multiple-point locking mechanism.

Figure 2:
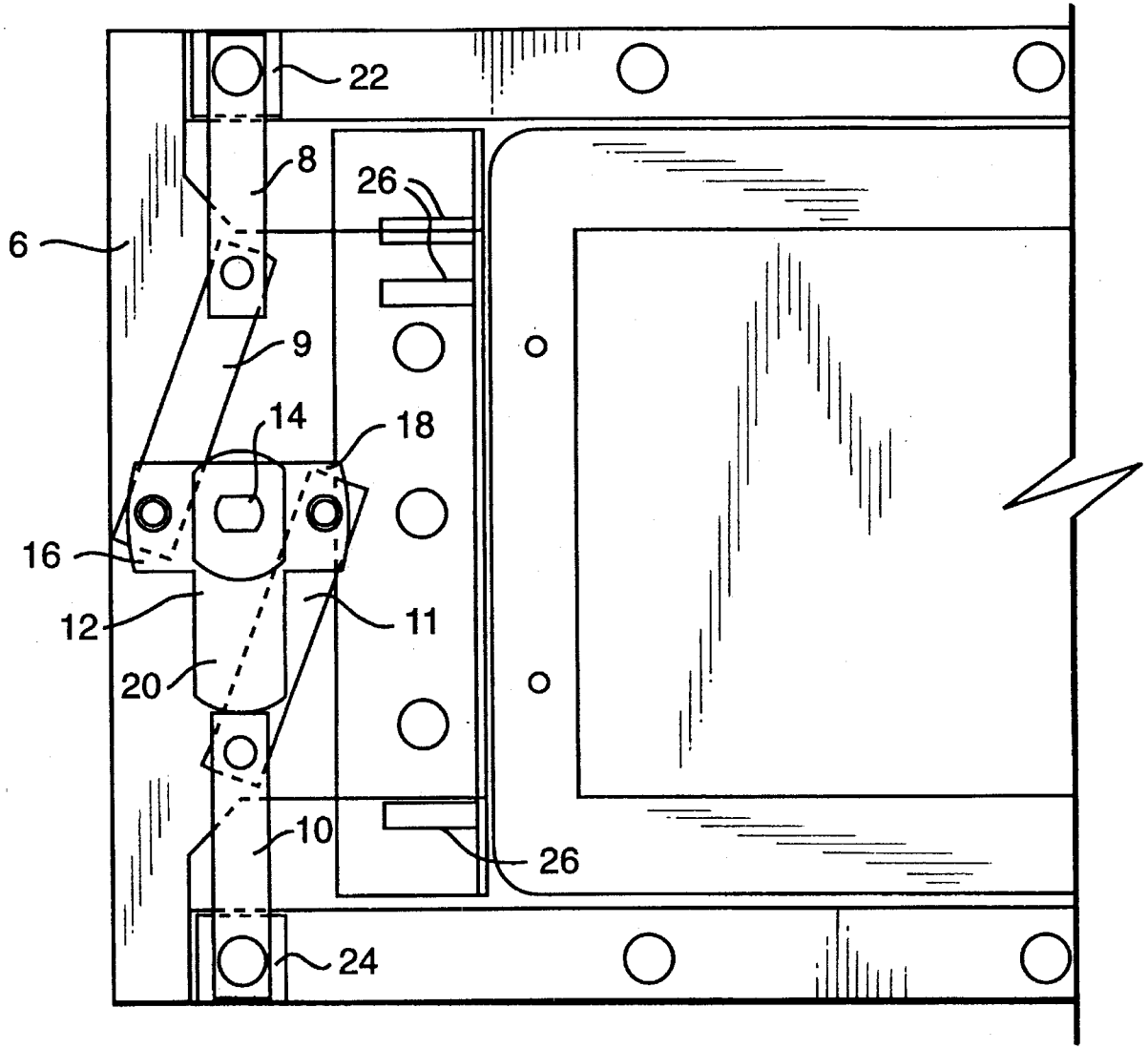
FIG. 2 shows a detail of the cut-away view of FIG. 1.

Referring to FIG. 2, the locking mechanism is described. The locking mechanism 6 as shown includes a first bolt 8 and a second bolt 10. As previously noted, the locking mechanism may have any number of bolts. The bolts 8 and 10 are cylindrical in form and are rotatably attached to a cam 12 through link members 9 and 11. The cam 12 is rotatably mounted to the door by a pin 14. The cam 12 has three extending members. The first extending member 16 is rotatably attached to the first bolt 8 through the first link member 9. The second extending member 18 is rotatably attached to the second bolt 10 through the second link member 11. The third extending member 20 can serve as a third resistance point when the door is locked.

The body of the lottery machine is fitted with two bolt receptacles. These bolt receptacles are elongated pieces having cylindrical bores. The first receptacle 22 is fixed to the machine body such that the axis of the cylindrical bore is aligned with the axis of the first bolt 8. Likewise, the second receptacle 24 is fixed to the machine body such that the axis of the cylindrical bore is aligned with the axis of the first bolt 10. Guide means 26 keep the bolts 8 and 10 aligned with the receptacles 22 and 24 whether the lock is in the open position, that is, unlocked, or in the closed position, that is, locked. The guide means 26 are shown offset in FIGS. 1 and 2 for clarity.

When the locking mechanism is in the open position, the bolts 8 and 10 are aligned with the receptacles 22 and 24 but are not located within the bores, allowing the door 2 to be opened freely about the hinge 4. When the locking mechanism is closed, the pin 14 is rotated ninety degrees. From the pespective presented in FIG. 2, the pin would be rotated in a clockwise direction to close the locking mechanism. This rotation may be accomplished in a number of ways. For example, if the pass device used in conjunction with the locking mechanism is a combination dial, this dial may enable or disable the turning of a handle that is attached to the pin 14. Thus, the handle may be rotated to rotate the pin 14. Alternatively, the pass device may be a key and tumbler apparatus that enables a similar handle or that is connected to the pin 14 and rotates the pin 14 directly when the key is turned.

When the pin 14 is rotated, the cam 12 rotates with it. The rotation of the cam 12 moves the link members 9 and 11 so as to cause a reciprocating motion in the bolts 8 and 10. The bolts 8 and 10 move toward the receptacles 22 and 24 until the bolts 8 and 10 enter the bores. At this point, opening of the door 2 is impossible, as the bolts impede movement of the door in any direction. As added security, the third extending member 20 of the cam 12 rotates under an edge of the machine body, further impeding movement of the door.

Figure 3A:
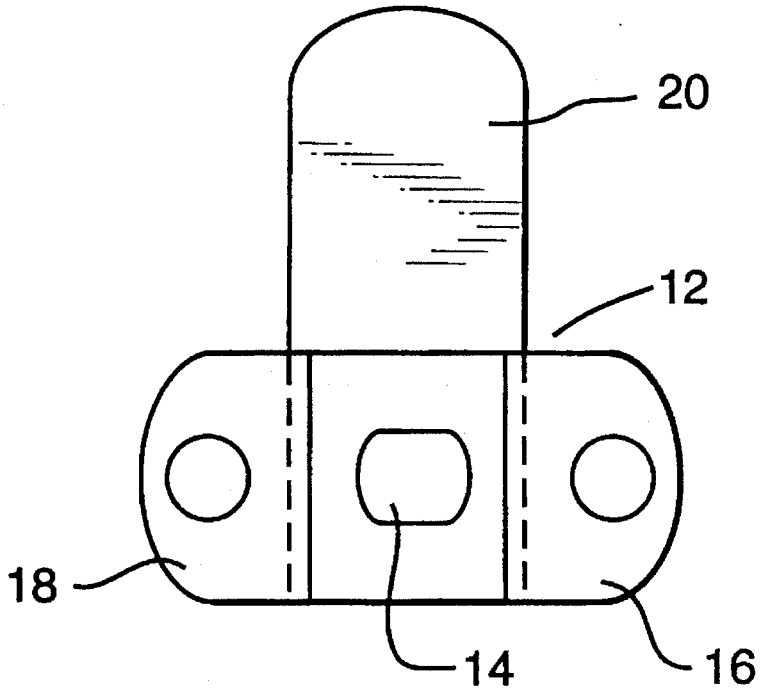
FIG. 3 shows a detail of a cam that may be used as part of the multiple-point locking mechanism; FIG. *3a* shows a top view and FIG. *3b* shows an end view.
Figure 3B:
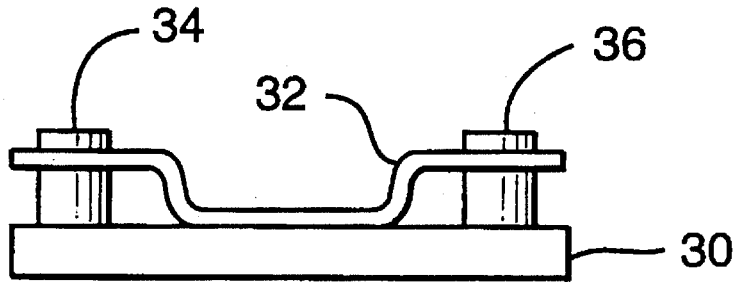

FIGS. 3*a* and 3*b* show a detail of the cam 12. As previously described, the cam includes cam extensions 16, 18, and 20 and a pin 14. The cam 12 is made of a flat base 30 and a curved plate 32 connected by two pegs 34 and 36. The pegs are the means by which the link members 9 and 11 are attached to the cam 12. Additional link members and bolts may be attached to the cam. For example, the cam may be designed with additional extensions, each extension attached to a link member. The machine body may be fitted with a corresponding number of receptacles. Alternatively, the cam may have multiple levels. That is, a number of cam bases and curved plates may be stacked in parallel, all connected by the same pegs. link members may then be attached to the cam through the pegs at each level, providing a larger number of resistance means. Again, the machine body may be fitted with a corresponding number of receptacles, all arranged in a parallel fashion. The cam may be modified in a number of other ways in order to achieve a greater number of resistance means.

Figure 4:
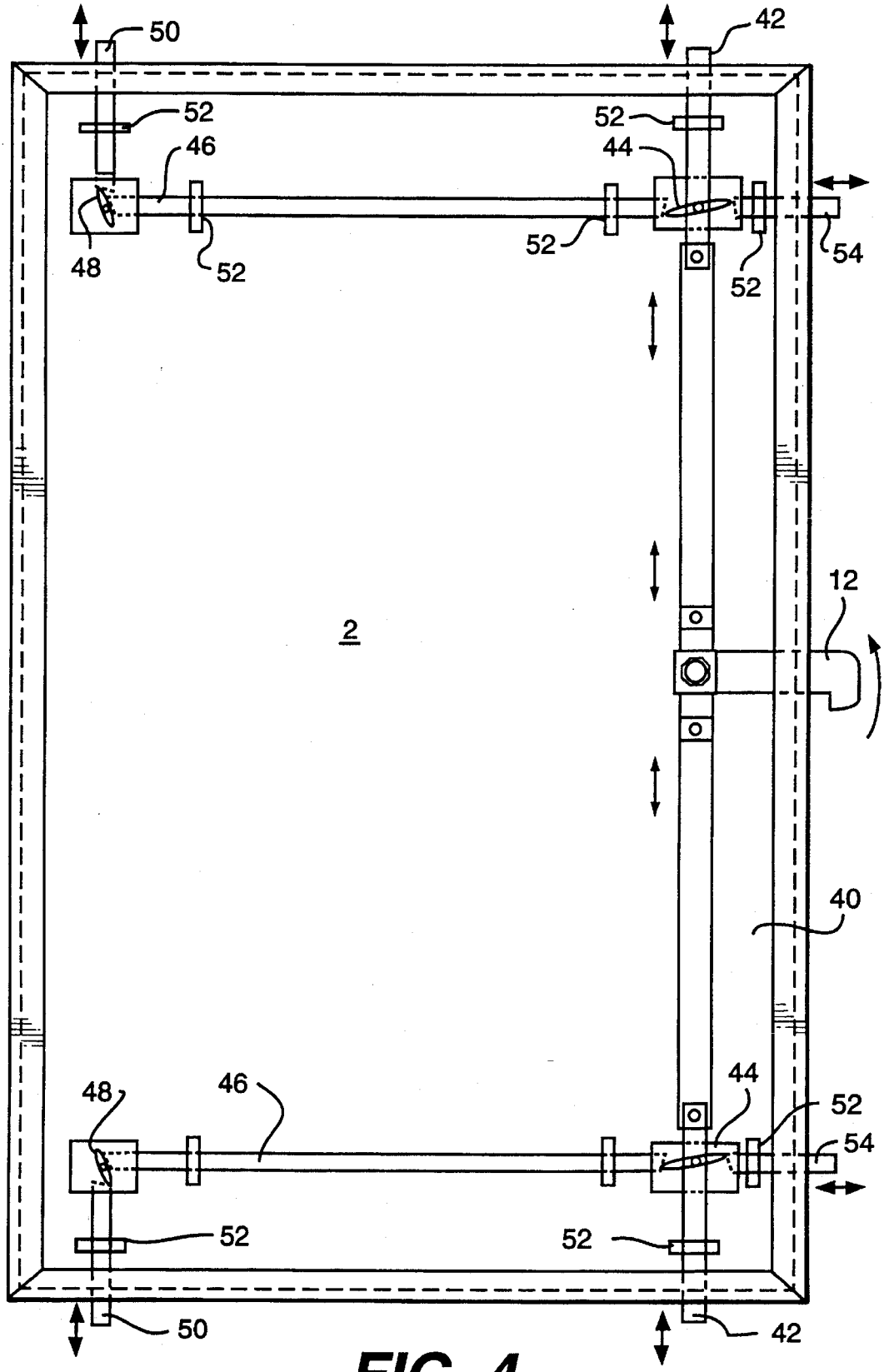
FIG. 4 shows a six-point three-direction embodiment of the present invention.

FIG. 4 illustrates another way by which multiple resistance means may be employed to lock the door 2. Rotation of the cam produces reciprocating motion in the link members 40. This motion in turn produces reciprocating motion in a first pair of bolts A diagonal motion translator 44 is rigidly fixed to the bolts 42 or to the link members 40. Through the motion translators 44, the reciprocating motion of the link members 40 is transferred to a second pair of bolts 54 such that the bolts 54 move in a direction perpendicular to the direction of movement of the bolts 42. The reciprocating motion of the motion translators 44 may also be transferred to a second pair of link members 46, which, through a second pair of diagonal motion translators 48, provide reciprocating motion to a third pair of bolts 50. All three pairs of bolts slide in and out of corresponding receptacles attached to the machine body. All bolts and link members are given direction and support by guide means 52. Through the use of this embodiment, the locking mechanism provides six resistance points in three different directions.

Preferred and alternate embodiments of the present invention have now been described in detail. It is to be noted, however, that this description of these specific embodiments is merely illustrative of the principles underlying the inventive concept. It is therefore contemplated that various modifications of the disclosed embodiments will, without departing from the spirit and scope of the invention, be apparent to persons skilled in the art.

What is claimed is:

1. A locking mechanism for an enclosure having an access opening, the locking mechanism comprising:

A) a door, hinged to the enclosure, for covering the access opening;

B) a cam, rotatably attached to the door and having an extension;

C) a first link member pivotally attached to the extension of the cam;

D) a first cylindrical bolt pivotally attached to the first link member;

E) a first receptacle, attached to the enclosure, the first receptacle having a first cylindrical bore;

F) the first bolt aligned with the first cylindrical bore;

G) a second receptacle attached to the enclosure, the second receptacle having a second cylindrical bore oriented substantially perpendicular to the first cylindrical bore;

H) a second bolt, slidingly connected to the door and aligned with the second cylindrical bore; and I) a first motion translator attached to the first bolt;

J) the first link member providing a means for translating rotational movement of the cam into reciprocating movement of the first bolt such that the first bolt enters the first cylindrical bore and such that the first motion translator pushes the second bolt into the second cylindrical bore.

2. The locking mechanism of claim 1, further comprising a spring attached to the second bolt and abutting the second receptacle such that the spring moves the second bolt out of the second cylindrical bore when the first motion translator is not pushing on the second bolt.

3. The locking mechanism of claim 1, further comprising guide means attached to the door for guiding the first bolt and the second bolt such that the first bolt remains aligned with the first cylindrical bore and the second bolt remains aligned with the second cylindrical bore regardless of rotational position of the cam.

4. The locking mechanism of claim 1, further comprising:

A) a second link member, located within guide means attached to the door and oriented substantially perpendicular to the first bolt;

B) a third receptacle, attached to the enclosure, the third receptacle having a third cylindrical bore oriented substantially perpendicular to the second bore;

C) a third bolt, slidingly connected to the door and aligned with the third cylindrical bore; and D) a second motion translator, attached to the second link member;

E) the first link member providing a means for translating rotational movement of the cam into reciprocating movement of the first bolt such that the first motion translator pushes the second link member toward the third bolt, the second motion translator pushing the third bolt into the third cylindrical bore.

5. The locking mechanism of claim 4, further comprising a spring attached to the third bolt and abutting the third receptacle such that the spring moves the third bolt out of the third cylindrical bore when the second motion translator is not pushing on the third bolt.

6. The locking mechanism of claim 1, further comprising:

A) a second link member, located within guide means attached to the door and oriented substantially perpendicular to the first bolt;

B) a third receptacle, attached to the enclosure, the third receptacle having a third cylindrical bore oriented substantially perpendicular to the second bore;

C) a third bolt, slidingly connected to the door and aligned with the third cylindrical bore; and D) a second motion translator, attached to the third bolt;

E) the first link member providing a means for translating rotational movement of the cam into reciprocating movement of the first bolt such that the first motion translator pushes the second link member toward the second motion translator, the second motion translator pushing the third bolt into the third cylindrical bore.

7. The locking mechanism of claim 6, further comprising a spring attached to the third bolt and abutting the third receptacle such that the spring moves the third bolt out of the third cylindrical bore when the second motion translator is not pushing on the third bolt.

8. The locking mechanism of claim 1, wherein the cam further comprises a second extension, the second extension rotating to a position under an edge of the enclosure when the first bolt is fully inserted in the first cylindrical bore.

9. A locking mechanism for an enclosure having an access opening, the locking mechanism comprising:

A) a door, hinged to the enclosure, for covering the access opening;

B) a cam, rotatably attached to the door and having an extension;

C) a first link member pivotally attached to the extension of the cam;

D) a first cylindrical bolt pivotally attached to the first link member;

E) a first receptacle, attached to the enclosure, the first receptacle having a first cylindrical bore;

F) the first bolt aligned with the first cylindrical bore;

G) a second receptacle attached to the enclosure, the second receptacle having a second cylindrical bore oriented substantially perpendicular to the first cylindrical bore;

H) a second bolt, slidingly connected to the door and aligned with the second cylindrical bore; and I) a first motion translator attached to the first link member;

J) the first link member providing a means for translating rotational movement of the cam into reciprocating movement of the first bolt such that the first bolt enters the first cylindrical bore and into reciprocating movement of the first motion translator such that the first motion translator pushes the second bolt into the second cylindrical bore.

10. The locking mechanism of claim 9, further comprising a spring attached to the second bolt and abutting the second receptacle such that the spring moves the second bolt out of the second cylindrical bore when the first motion translator is not pushing on the second bolt.

11. The locking mechanism of claim 9, further comprising guide means attached to the door for guiding the first bolt and the second bolt such that the first bolt remains aligned with the first cylindrical bore and the second bolt remains aligned with the second cylindrical bore regardless of rotational position of the cam.

12. The locking mechanism of claim 9, further comprising:

A) a second link member, located within guide means attached to the door and oriented substantially perpendicular to the first bolt;

B) a third receptacle, attached to the enclosure, the third receptacle having a third cylindrical bore oriented substantially perpendicular to the second bore;

C) a third bolt, slidingly connected to the door and aligned with the third cylindrical bore; and D) a second motion translator, attached to the second link member;

E) the first link member providing a means for translating rotational movement of the cam into reciprocating movement of the first link member such that the first motion translator pushes the second link member toward the third bolt, the second motion translator pushing the third bolt into the third cylindrical bore.

13. The locking mechanism of claim 12, further comprising a spring attached to the third bolt and abutting the third receptacle such that the spring moves the third bolt out of the third cylindrical bore when the second motion translator is not pushing on the third bolt.

14. The locking mechanism of claim 9, further comprising:

A) a second link member, located within guide means attached to the door and oriented substantially perpendicular to the first bolt;

B) a third receptacle, attached to the enclosure, the third receptacle having a third cylindrical bore oriented substantially perpendicular to the second bore;

C) a third bolt, slidingly connected to the door and aligned with the third cylindrical bore; and D) a second motion translator, attached to the third bolt;

E) the first link member providing a means for translating rotational movement of the cam into reciprocating movement of the first link member such that the first motion translator pushes the second link member toward the second motion translator, the second motion translator pushing the third bolt into the third cylindrical bore.

15. The locking mechanism of claim 14, further comprising a spring attached to the third bolt and abutting the third receptacle such that the spring moves the third bolt out of the third cylindrical bore when the second motion translator is not pushing on the third bolt.

16. The locking mechanism of claim 9, wherein the cam further comprises a second extension, the second extension rotating to a position under an edge of the enclosure when the first bolt is fully inserted in the first cylindrical bore.

17. A locking mechanism for an enclosure, comprising:

A) a door, pivotally connected to the enclosure;

B) a cam, rotatably connected to the door;

C) a first lock assembly, pivotally attached to the cam at a fixed end and slidingly attached to the door at a free end, the first lock assembly comprising a first motion translator;

D) a second lock assembly, slidingly attached to the door and oriented substantially perpendicular to the first lock assembly, the second lock assembly having a first contact region and an insertion end;

E) a first receptacle, attached to the enclosure and having a first cylindrical bore; and F) a second receptacle, attached to the enclosure and having a second cylindrical bore oriented substantially perpendicular to the first cylindrical bore;

G) the first lock assembly being aligned such that motion of the cam pushes the free end of the first lock assembly into the first cylindrical bore; and H) the first motion translator being located such that motion of the first lock assembly causes the first motion translator to push the insertion end of the second lock assembly into the second cylindrical bore.

18. The locking mechanism of claim 17, wherein:

A) the second lock assembly further comprises an extension extending from the first contact region to a second contact region;

B) the second lock assembly further comprises a second motion translator at the second contact region;

C) the locking mechanism further comprises a third lock assembly having an insertion end and a contact end in contact with the second lock assembly at the second contact region; and D) the locking mechanism further comprises a third receptacle having a third cylindrical bore oriented substantially perpendicular to the second cylindrical bore;

E) motion of the cam causing the first motion translator to push the second lock assembly extension toward the third lock assembly and causing the second motion translator to push the third lock assembly insertion end into the third cylindrical bore.

19. The locking mechanism of claim 17, wherein:

A) the second lock assembly further comprises an extension extending from the first contact region to a second contact region;

B) the locking mechanism further comprises a third lock assembly having an insertion end and a contact end in contact with the second lock assembly at the second contact region, the third lock assembly further comprising a second motion translator; and C) the locking mechanism further comprises a third receptacle having a third cylindrical bore oriented substantially perpendicular to the second cylindrical bore;

D) motion of the cam causing the first motion translator to push the second lock assembly extension toward the third lock assembly and causing the second motion translator to push the third lock assembly insertion end into the third cylindrical bore.

20. The locking mechanism of claim 17, wherein the cam further comprises a projection, the projection rotating to a position under an edge of the enclosure when the free end of the first lock assembly is fully inserted in the first cylindrical bore.

* * * * *